US008118504B2

(12) United States Patent
Huang

(10) Patent No.: US 8,118,504 B2
(45) Date of Patent: Feb. 21, 2012

(54) PRINTER

(75) Inventor: Szu-Hai Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 343 days.

(21) Appl. No.: 12/615,238

(22) Filed: Nov. 9, 2009

(65) Prior Publication Data

US 2010/0309263 A1 Dec. 9, 2010

(30) Foreign Application Priority Data

Jun. 8, 2009 (CN) ..... 2009 1 0303026

(51) Int. Cl.
*B41J 11/20* (2006.01)

(52) U.S. Cl. ..... 400/59

(58) Field of Classification Search ..... 347/32; 400/55, 58, 59
See application file for complete search history.

(56) References Cited

U.S. PATENT DOCUMENTS

| | | | | |
|---|---|---|---|---|
| 5,339,102 | A * | 8/1994 | Carlotta | 347/32 |
| 6,000,779 | A * | 12/1999 | Ng et al. | 347/24 |
| 6,533,386 | B1 * | 3/2003 | Sawicki et al. | 347/32 |
| 7,040,819 | B2 * | 5/2006 | Takeshita et al. | 400/58 |

* cited by examiner

*Primary Examiner* — Anh T. N. Vo
(74) *Attorney, Agent, or Firm* — Altis Law Group, Inc.

(57) ABSTRACT

A printer includes a chassis, an ink cartridge, and an adjusting unit. The ink cartridge carrier is mounted to the chassis. A projection extends from the ink cartridge carrier. The adjusting unit includes a rotating shaft, a cam fixed to the rotating shaft, and a gear fixed to the rotating shaft. The gear includes a number of teeth. The rotating shaft is rotatably mounted to the ink cartridge carrier. The projection is clipped between two adjacent teeth. The cam abuts against the chassis.

15 Claims, 6 Drawing Sheets

PRINTER

BACKGROUND

1. Technical Field

The present disclosure relates to printers, and particularly to a printer whose ink cartridge carrier can be adjusted.

2. Description of Related Art

An ink cartridge carrier is configured for holding an ink cartridge of a printer. Commonly, a print head is mounted to the carrier or the ink cartridge. A distance between the print head and a printing medium, such as a piece of paper, is one of the important indicators that impact the printing quality. When a printer is manufactured, there are processing errors and assembly errors, which leads the distance between the print head and the printing medium being not accurate, and thereby the printing quality is downgraded.

DETAILED DESCRIPTION

Figure 1:
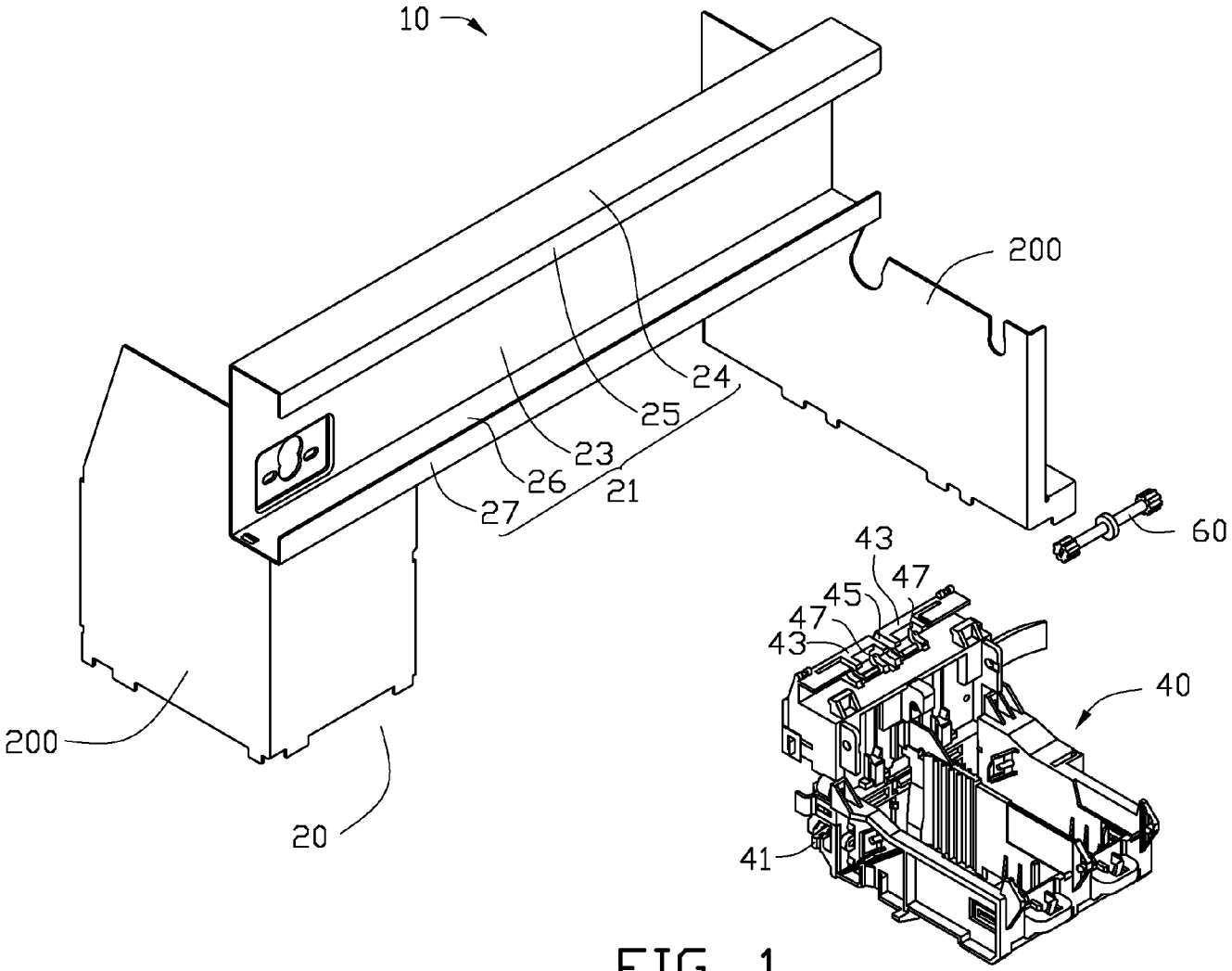
FIG. 1 is an exploded, isometric view of an embodiment of a printer, the printer including an ink cartridge carrier and an adjusting unit.

Referring to FIG. 1, an embodiment of a printer 10 includes a chassis 20, an ink cartridge carrier 40, and an adjusting unit 60.

The chassis 20 includes a slide rail 21, and a plurality of supports 200 for supporting the slide rail 21. The slide rail 21 is used for slidably mounting the ink cartridge carrier 40. The slide rail 21 includes a vertical rear board 23, a top board 24 extending horizontally from an upper side of the rear board 23, a bottom board 26 extending horizontally from a lower side of the rear board 23 and opposite to the top board 24, an upper bending piece 25 extending perpendicularly from a front side of the top board 24 away from the rear board 23 towards the bottom board 26, and a lower bending piece 27 extending perpendicularly from a front side of the bottom board 26 away from the rear board 23 towards the top board 24.

Figure 2:
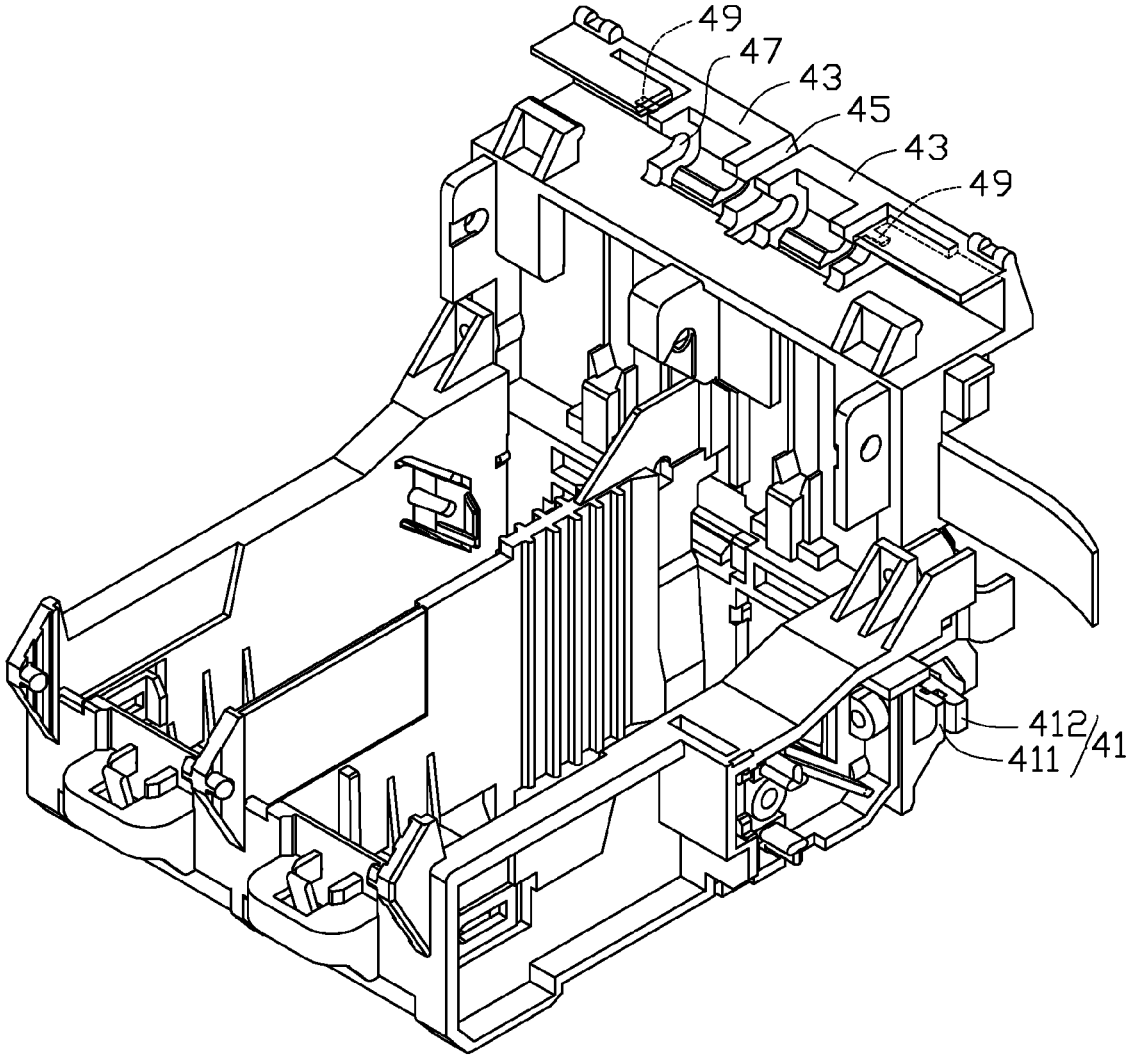
FIG. 2 is an enlarged view of the ink cartridge carrier in FIG. 1, but viewed from another perspective.

Referring to FIG. 2, the ink cartridge carrier 40 is used to hold an ink cartridge (not shown). The ink cartridge carrier 40 or the ink cartridge includes a print head (not shown). In one embodiment, the print head is mounted to a front portion of the ink cartridge carrier 40. Two sliding portions 41 extend from a lower end of a rear portion opposite to the front portion of the ink cartridge carrier 40. Each sliding portion 41 includes spaced first clipping piece 411 and second clipping piece 412. Two shaft holders 43 extend from a top of the rear portion of the ink cartridge carrier 40. Two C-shaped rotating holes 47 are defined in each shaft holder 43. A groove 45 is defined in the ink cartridge carrier 40 between the shaft holders 43. Two projections 49 extend downwards from the top of the rear portion of the ink cartridge carrier 40. The projections 49 are located at the left and right sides of the two shaft holders 43 respectively, and are a little higher than the rotating holes 47.

Figure 3:
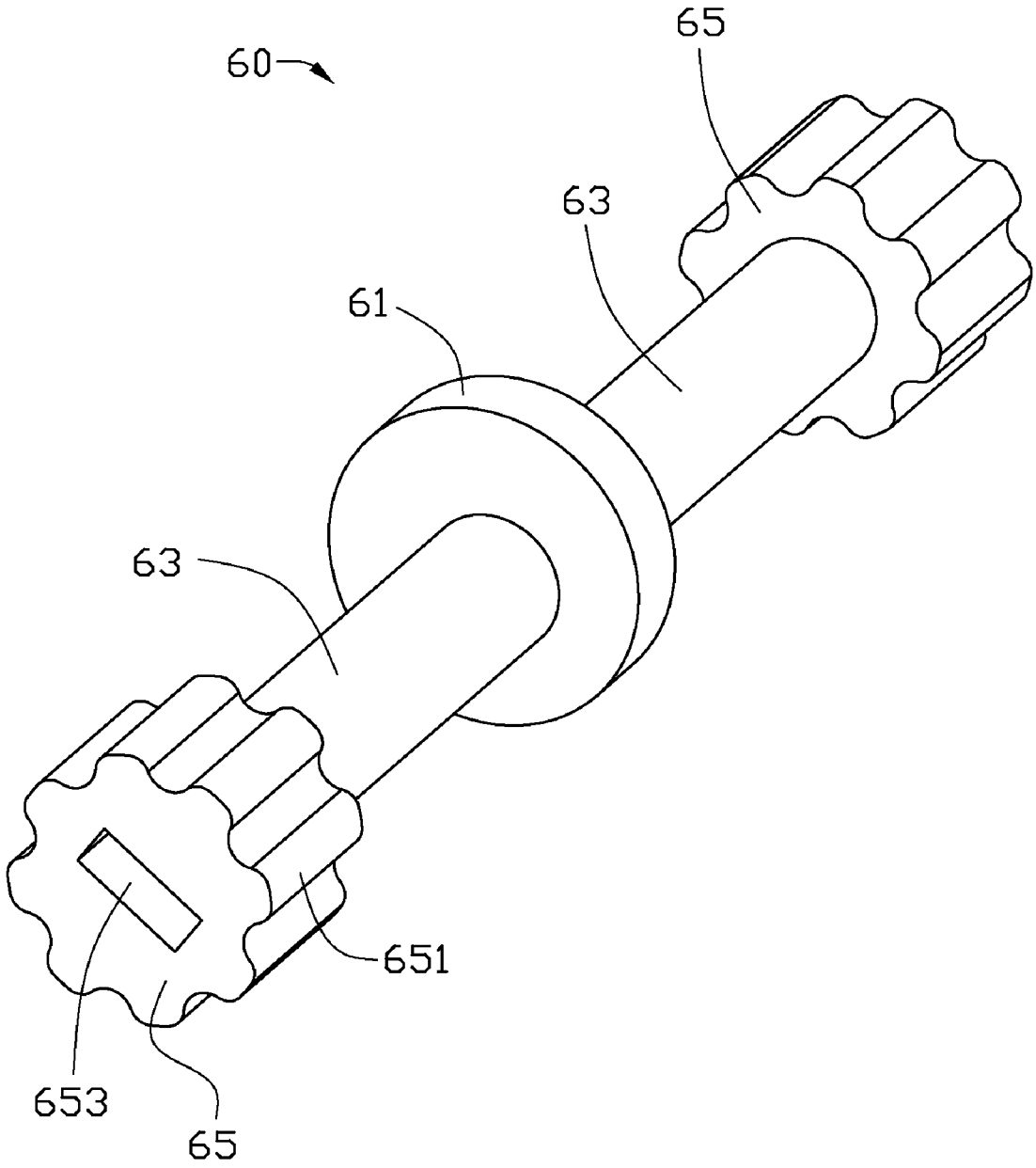
FIG. 3 is an enlarged view of the adjusting unit in FIG. 1.

Referring to FIG. 3, the adjusting unit 60 includes a cam 61, two rotating shafts 63, and two gears 65. The rotating shafts 63 coaxially extend from opposite sides of the cam 61. The gears 65 are fixed to distal ends of the rotating shafts 63 away from the cam 61, respectively. Each gear 65 includes eight teeth 651. An operating hole 653 is defined in a side of each gear 65, opposite to the cam 61.

Figure 4:
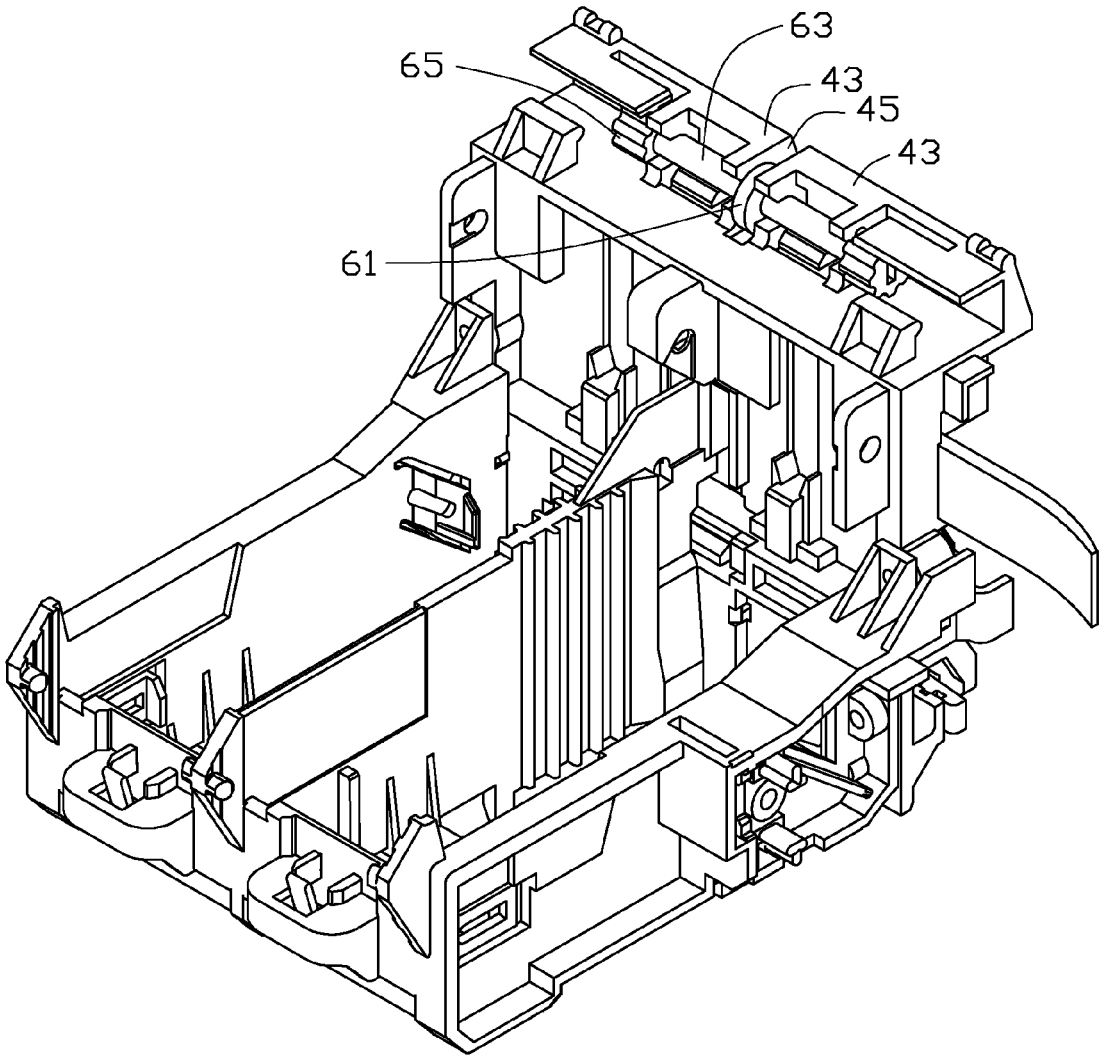
FIG. 4 is an assembled view of the ink cartridge carrier and the adjusting unit in FIG. 1, but viewed from another perspective.
Figure 5:
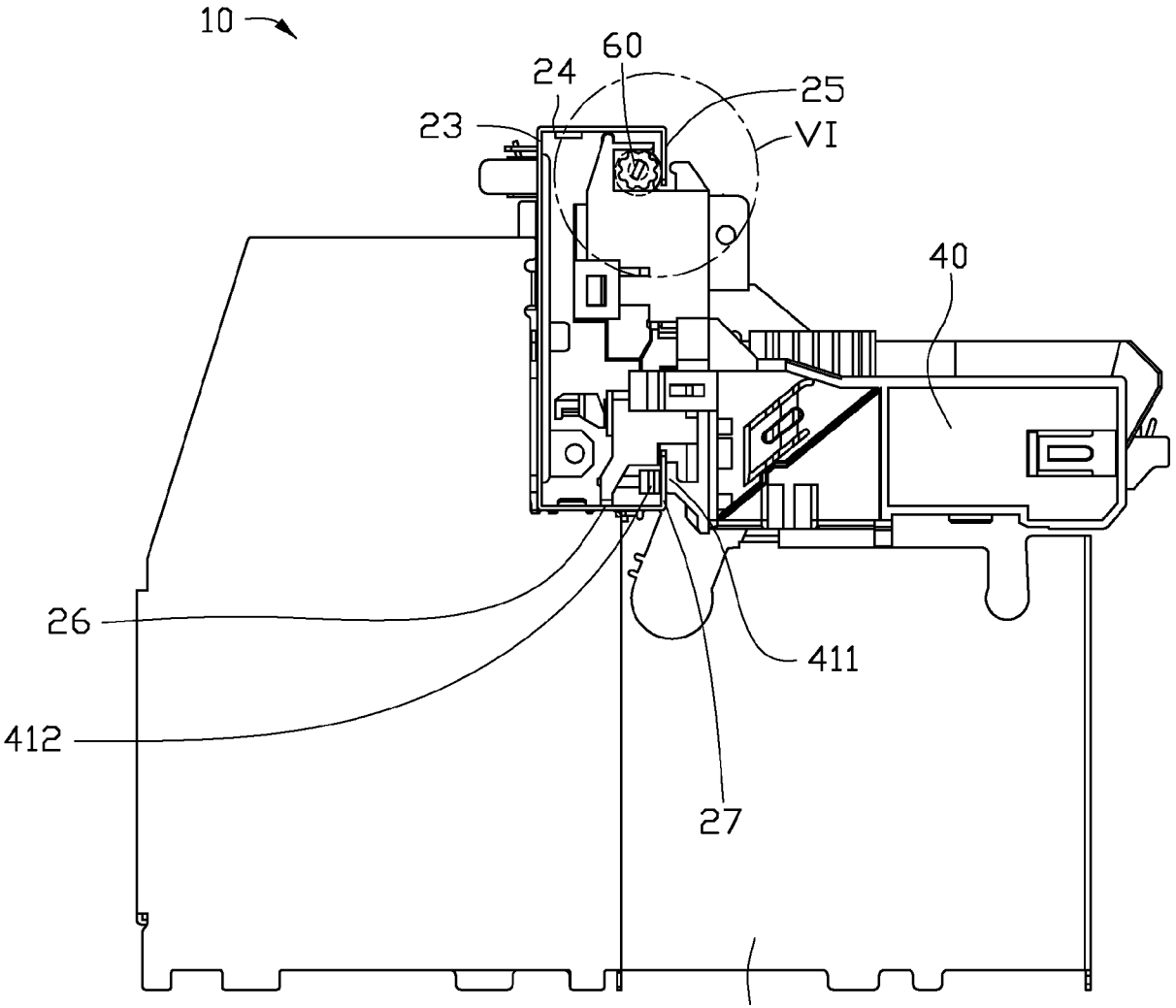
FIG. 5 is an assembled, side elevational view of the printer in FIG. 1.
Figure 6:
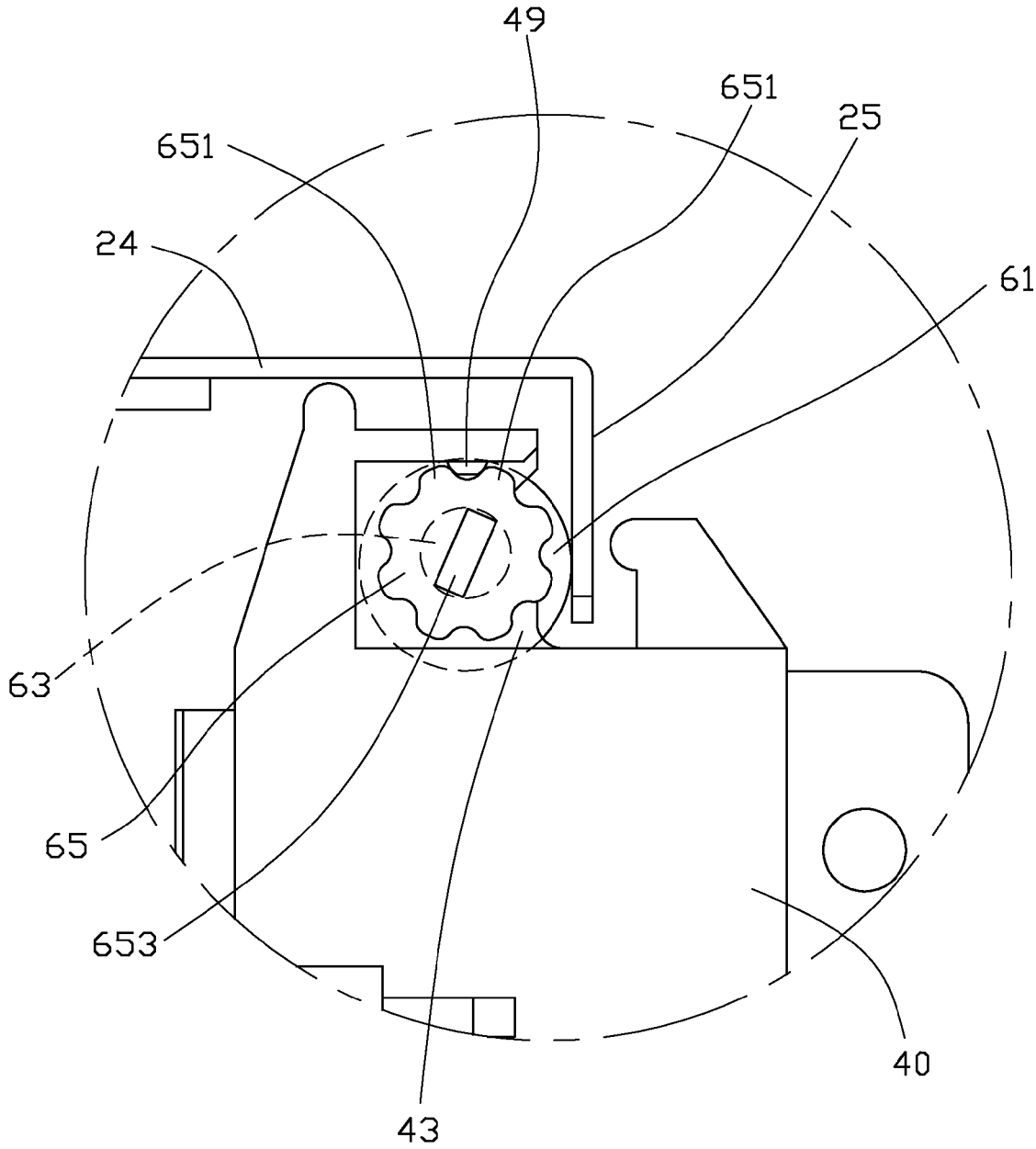
FIG. 6 is an enlarged view of the circled portion VI in FIG. 5.

Referring to FIGS. 4 and 5, in assembly, the rotating shafts 63 of the adjusting unit 60 are snapped in the rotating holes 47 of the shaft holders 43 of the ink cartridge carrier 40, while the cam 61 of the adjusting unit 60 is received in the groove 45 between the shaft holders 43, and each projection 49 of the ink cartridge carrier 40 is clipped between two adjacent teeth 651 of the corresponding gear 65 (see FIG. 6). The ink cartridge carrier 40 is mounted to the slide rail 21 from an end of the slide rail 21. The lower bending piece 27 of the slide rail 21 is sandwiched between the first clipping pieces 411 and second clipping pieces 412 of the sliding portions 41 of the ink cartridge carrier 40. The cam 61 abuts against an inner side of the upper bending piece 25 of the slide rail 21 (see FIG. 6).

Referring to FIG. 6, a printing medium (not shown), such as a piece of paper, can be placed under the ink cartridge carrier 40. When a distance between the print head of the ink cartridge carrier 40 and the printing medium needs to be adjusted, a screw driver (not shown) may be employed to insert into the operating hole 653 of one of the gears 65 or a plier (not shown) may be employed to clamp one of the gears 65, to rotate the adjusting unit 60. Because the cam 61 abuts against the upper bending piece 25 of the slide rail 21 and is rotated, a counterforce of the upper bending piece 25 acts on the cam 61. The counterforce is passed to the ink cartridge carrier 40 via the adjusting unit 60 to cause slight elastic deformation of the sliding portions 41 of the ink cartridge carrier 40, which causes the ink cartridge carrier 40 to slightly rotate relative to the lower bending piece 27 of the slide rail 21. Therefore, a purpose of adjusting the distance between the print head and the printing medium can be achieved. When the cam 61 is rotated to a desired position, each projection 49 is clipped between certain two adjacent teeth 651 of the corresponding gear 65, such that the cam 61 is positioned.

In other embodiments, one of the gears 65 and the corresponding rotating shaft 63 may be omitted, and a hole like the operating hole 653 may be defined in the cam 61.

In other embodiments, only one rotating hole 47 may be directly defined in each shaft holder 43.

In other embodiments, one of the sliding portions 41 of the ink cartridge carrier 40 may be omitted.

In other embodiments, the number of the teeth 65 of each gear 65 may be adjusted, to change a times that the cam 61 is able to be positioned in a rotating cycle, so as to change an adjustment precision of the ink cartridge carrier 40.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A printer comprising:

a chassis;

an ink cartridge carrier mounted to the chassis, wherein a projection extends from the ink cartridge carrier; and an adjusting unit comprising a rotating shaft, a cam fixed to the rotating shaft, and a gear fixed to the rotating shaft, wherein the gear comprises a plurality of teeth;

wherein the rotating shaft is rotatably mounted to the ink cartridge carrier, the projection is clipped between any two adjacent teeth of corresponding gear, and the cam abuts against the chassis.

2. The printer of claim 1, wherein the chassis comprises a slide rail, the ink cartridge carrier is mounted to the slide rail, the cam abuts against the slide rail.

3. The printer of claim 2, wherein a shaft holder extends from the ink cartridge carrier, a C-shaped rotating hole is defined in the shaft holder, the rotating shaft is rotatably snapped in the rotating hole.

4. The printer of claim 3, wherein the slide rail comprises a vertical rear board, a top board extending horizontally from an upper side of the rear board, and an upper bending piece extending down from a front side of the top board away from the rear board, the cam abuts against the upper bending piece.

5. The printer of claim 4, wherein the projection is higher than the rotating hole of the shaft holder and extends downward.

6. The printer of claim 4, wherein the slide rail further comprises a bottom board extending horizontally from a lower side of the rear board and opposite to the top board, and a lower bending piece extending upward from a front side of the bottom board away from the rear board, a sliding portion extends from the ink cartridge carrier, the sliding portion comprises first clipping piece and second clipping piece, the lower bending piece is sandwiched between the first clipping piece and second clipping piece.

7. The printer of claim 1, wherein the cam and the gear are fixed to opposite ends of the rotating shaft.

8. The printer of claim 7, wherein at least one of the cam and the gear defines an operating hole in a side away form the rotating shaft of the cam or the gear.

9. A printer comprising:

a chassis;

an ink cartridge carrier mounted to the chassis, wherein two spaced projections extend from the ink cartridge carrier; and an adjusting unit comprising a cam, two rotating shafts, and two gears, wherein the rotating shafts coaxially extend from opposite sides of the cam, the gears are fixed to distal ends away from the cam of the rotating shafts respectively and corresponding to the projections, each of the gears comprises a plurality of teeth;

wherein the rotating shafts are rotatably mounted to the ink cartridge carrier, each of the projections is clipped between any two adjacent teeth of a corresponding one of the gears, and the cam abuts against the chassis.

10. The printer of claim 9, wherein two shaft holders extend from the ink cartridge carrier corresponding to the rotating shafts, a C-shaped rotating hole is defined in each of the shaft holders, the rotating shafts are rotatably snapped in the rotating holes of the corresponding shaft holders, a groove is defined in the ink cartridge carrier between the shaft holders, the cam is received in the groove.

11. The printer of claim 9, wherein the chassis comprises a slide rail, the ink cartridge carrier is mounted to the slide rail, the cam abuts against the slide rail.

12. The printer of claim 11, wherein the slide rail comprises a vertical rear board, a top board extending horizontally from an upper side of the rear board, and an upper bending piece extending down from a front side of the top board away from the rear board, the cam abuts against the upper bending piece.

13. The printer of claim 12, wherein each of the projections is higher than the rotating hole of the corresponding shaft holder and extends downward.

14. The printer of claim 12, wherein the slide rail further comprises a bottom board extending horizontally from a lower side of the rear board and opposite to the top board, and a lower bending piece extending upward from a front side of the bottom board away from the rear board, a sliding portion extends from the ink cartridge carrier, the sliding portion comprises fore-and-aft spaced first clipping piece and second clipping piece, the lower bending piece is sandwiched between the first clipping piece and second clipping piece.

15. The printer of claim 9, wherein at least one of the gears defines an operating hole in a side of the gear, away from the cam.

* * * * *